US010355396B2

(12) United States Patent
Zhao

(10) Patent No.: US 10,355,396 B2
(45) Date of Patent: Jul. 16, 2019

(54) ELECTRICAL CONNECTOR HAVING FRONT AND REAR SEALING MEMBERS

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/825,126

(22) Filed: Nov. 29, 2017

(65) Prior Publication Data

US 2018/0151978 A1 May 31, 2018

(30) Foreign Application Priority Data

Nov. 29, 2016 (CN) ..... 2016 1 1069474
Nov. 29, 2016 (CN) ..... 2016 2 1294608 U

(51) Int. Cl.

| | |
|---|---|
| ***H01R 13/52*** | (2006.01) |
| ***H01R 13/6582*** | (2011.01) |
| ***H01R 13/6587*** | (2011.01) |
| *H01R 43/00* | (2006.01) |
| *H01R 12/72* | (2011.01) |

(Continued)

(52) U.S. Cl.

CPC ..... *H01R 13/5208* (2013.01); *H01R 13/5219* (2013.01); *H01R 13/6582* (2013.01); *H01R 13/6587* (2013.01); *H01R 12/724* (2013.01); *H01R 13/5202* (2013.01); *H01R 13/5216* (2013.01); *H01R 24/60* (2013.01); *H01R 24/62* (2013.01); *H01R 43/005* (2013.01)

(58) Field of Classification Search

CPC ..... H01R 13/5208; H01R 13/5202; H01R 13/5219; H01R 13/6582; H01R 13/6587; H01R 13/6585; H01R 13/5216; H01R 12/724; H01R 24/60; H01R 24/62; H01R 43/005

USPC ..... 439/587, 660, 607.05, 607.51, 607.57, 439/607.58, 607.35, 607.36, 607.13

See application file for complete search history.

(56) References Cited

U.S. PATENT DOCUMENTS 9,331,421 B2 * 5/2016 Lai ..... H01R 13/5202
9,429,360 B2 * 8/2016 Hsiao ..... F26B 3/28

(Continued)

FOREIGN PATENT DOCUMENTS

| | | |
|---|---|---|
| CN | 204167590 U | 2/2015 |
| CN | 205016762 U | 2/2016 |
| CN | 105470697 A | 4/2016 |

*Primary Examiner* — Harshad C Patel
(74) *Attorney, Agent, or Firm* — Wei Te Chung; Ming Chieh Chang

(57) ABSTRACT

An electrical connector includes: an insulative housing having a base and a tongue; plural contacts affixed to the insulative housing and exposed to the tongue; a shielding shell enclosing the insulative housing and having a front end; an outer cover enclosing the shielding shell and having a front protrusion, an annular slot being defined between the front end of the shielding shell and the front protrusion of the outer cover; a rear sealer sealing an interfacing gap between the shielding shell and the outer cover; and a front sealer disposed in the annular slot; wherein at least one of the shielding shell, the outer cover, and the front sealer has a groove in fluid communication with the interfacing gap.

4 Claims, 11 Drawing Sheets

(51) Int. Cl.
*H01R 24/62* (2011.01)
*H01R 24/60* (2011.01)

(56) References Cited

U.S. PATENT DOCUMENTS

| | | | | |
|---|---|---|---|---|
| 2015/0155661 | A1* | 6/2015 | Chen | H01R 13/6582<br>439/607.01 |
| 2015/0244111 | A1* | 8/2015 | Ju | H01R 13/6585<br>439/607.05 |
| 2015/0325944 | A1* | 11/2015 | Chien | H01R 13/5202<br>439/271 |
| 2016/0093974 | A1* | 3/2016 | Lai | H01R 13/5202<br>439/736 |
| 2016/0181723 | A1* | 6/2016 | Tsai | H01R 13/5202<br>439/587 |
| 2016/0233594 | A1* | 8/2016 | Zhao | H01R 13/6581 |
| 2016/0294105 | A1* | 10/2016 | Zhao | H01R 13/5202 |

* cited by examiner

ELECTRICAL CONNECTOR HAVING FRONT AND REAR SEALING MEMBERS

BACKGROUND OF THE INVENTION

1. Field of the Invention

The present invention relates to an electrical connector including a front sealing member securely disposed in a groove defined between a shielding shell and an outer cover thereof.

2. Description of Related Arts

China Patent No. 205016762 discloses an electrical connector including an insulative housing, a plurality of conductive terminals secured to the insulative housing, a metal shell enclosing the insulative housing, an outer cover enclosing the metal shell and having an outer peripheral recess, and a sealing member or sealer attached to the recess with the aid of an adhesive.

An electrical connector having a sealer firmly secured in place is desired.

SUMMARY OF THE INVENTION

An electrical connector comprises: an insulative housing having a base and a tongue; a plurality of contacts affixed to the insulative housing and exposed to the tongue; a shielding shell enclosing the insulative housing and having a front end; an outer cover enclosing the shielding shell and having a front protrusion, an annular slot being defined between the front end of the shielding shell and the front protrusion of the outer cover; a rear sealer sealing an interfacing gap between the shielding shell and the outer cover; and a front sealer disposed in the annular slot; wherein at least one of the shielding shell, the outer cover, and the front sealer has a groove in fluid communication with the interfacing gap.

DETAILED DESCRIPTION OF THE PREFERRED EMBODIMENT

Figure 1:
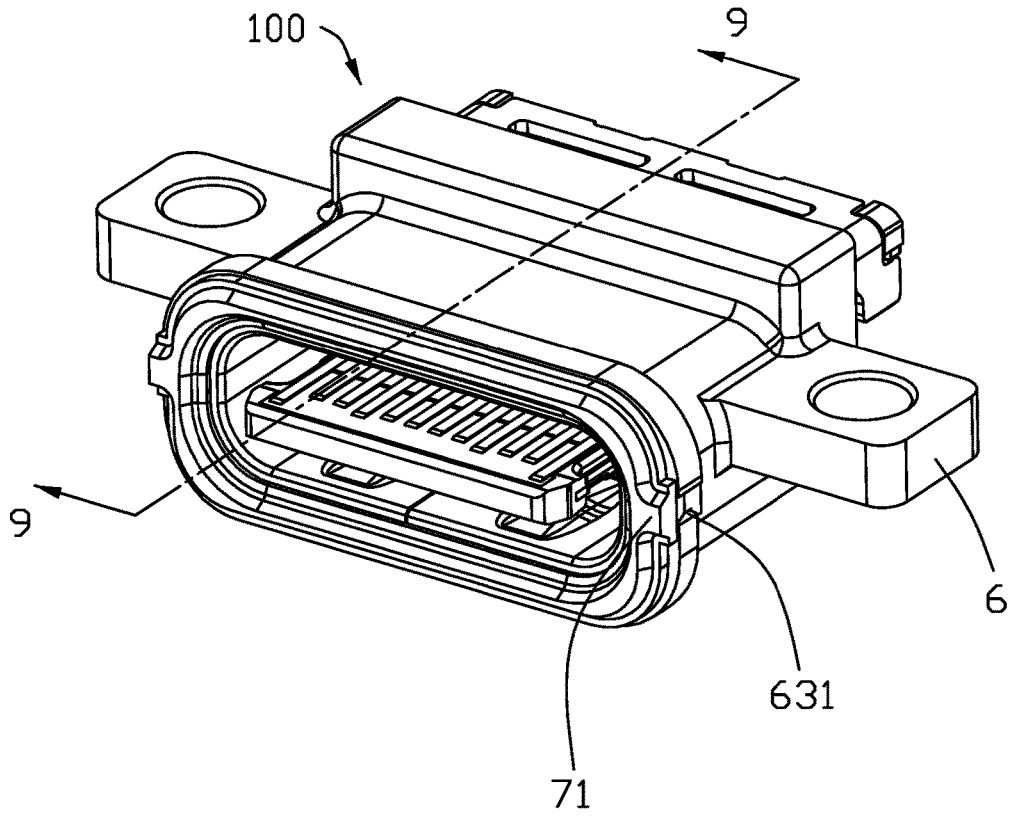
FIG. 1 is a perspective view of an electrical connector in accordance with a first embodiment of the present invention.
Figure 2:
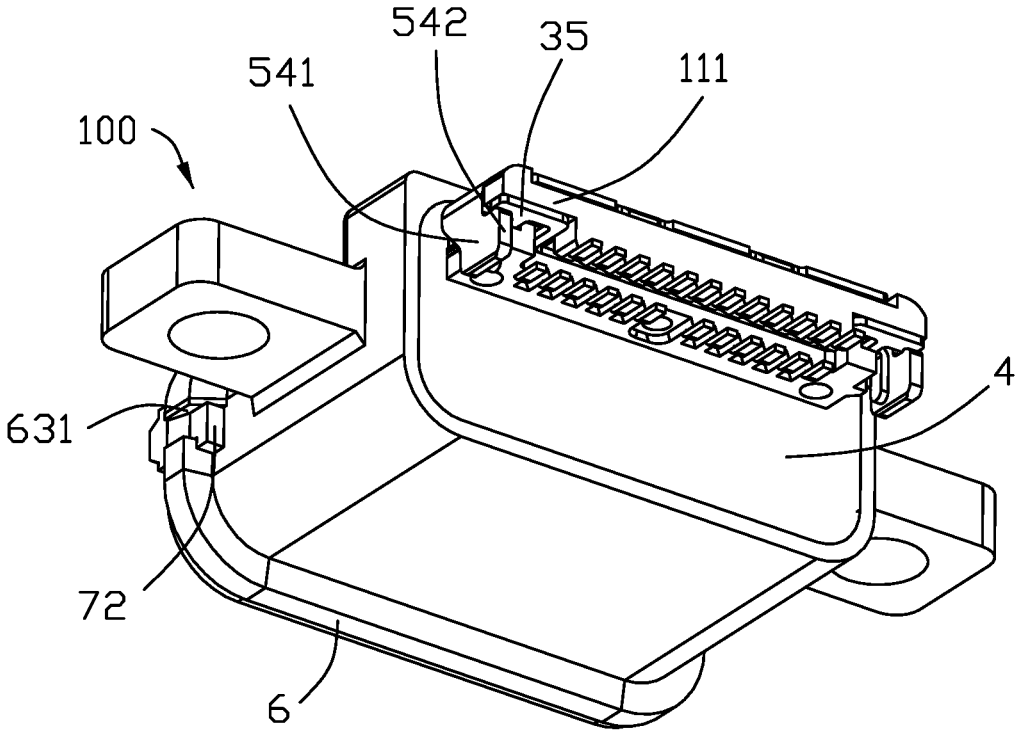
FIG. 2 is another perspective view of the electrical connector.

Referring to FIGS. 1 to 8, an electrical connector 100 includes an insulative housing 1, a plurality of contacts 2 affixed to the insulative housing 1, a shielding shell 5 enclosing the insulative housing 1, an outer cover 6 enclosing the shielding shell 5, a rear sealing member or sealer 4, and a front sealing member or sealer 7. The electrical connector 100 may further include a middle metal plate 3.

Referring further to FIGS. 5-8, the insulative housing 1 includes a first insulator 11, a second insulator 12, and a third insulator 13. The first insulator 11 includes a base 111 and a tongue 112 extending forwardly from the base 111. The base 111 includes a flat 114 and a connection 113 connected to the tongue 112. The flat 114 has an opening 115 for exposing contacts. The tongue 112 has plural blocks 116 at an upper surface thereof and plural protrusions 117 at a lower surface thereof. The base 111 has two holes 118 and two abutments 119. The second insulator 12 includes a base 121 and a tongue 122 extending forwardly from the base 121. The base 121 includes a connection 123 connected to the tongue 122. The connection 123 includes a pair of connecting portions 124 clamping the connection 113 of the base 111 and a pair of angled portions 125 above the connecting portions 124 for engaging the two front corners of the flat 114 of the base 111. The tongue 122 has plural features 126 for engaging the protrusions 117 of the tongue 112 and plural blocks 127. The base 121 has latches 128 for engaging the holes 118. The third insulator 13 includes a base 131 and a tongue 132 extending forwardly from the base 131. The tongue 132 has voids 133 occupied by the tongues 112 and 122 of the first and second insulators 11 and 12 and two side notches 134. The bases 111, 121, and 131 constitute an overall base of the insulative housing 1 and the tongues 121, 122, and 132 constitute an overall tongue of the insulative housing 1.

The plurality of contacts 2 include a row of upper contacts 21 secured to the first insulator 11 and a row of lower contacts 22 secured to the second insulator 12. Each of the upper contacts 21 includes a contacting portion 211 and a tail 212. Each of the lower contacts 22 includes a contacting portion 221 and a tail 222. The upper contacts 21 and the lower contacts 22 are equal in number. Each contacting portion 211 of the upper contacts 21 is positioned in reverse symmetry with respect to a respective one of the lower contacts 22.

Referring again to FIGS. 7-8, the metal plate 3 includes a front portion 31, a rear portion 32, and a connecting portion 33. The connecting portion 33 includes a through hole 30 in a middle thereof. The rear portion 32 comprises a pair of soldering pins 34 located at a rear end thereof and extending to both sides, a pair of securing portions 35 behind the soldering pins 34, and a pair of positioning holes 36 for passing the latches 128 of the base 121.

Referring specifically to FIGS. 4-9, the sealer 4 is formed in place by applying and solidifying suitable material in the opening 115 to seal an interfacing gap between the shielding shell 5 and the outer cover 6.

Figure 3:
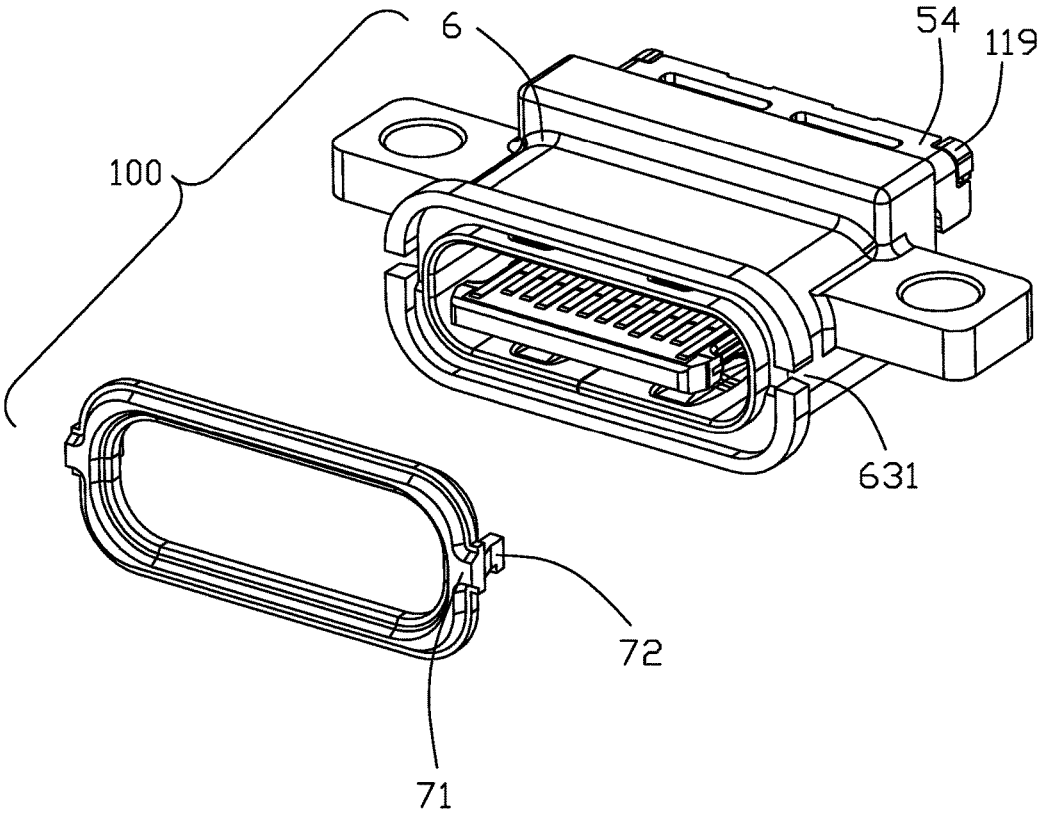
FIG. 3 is a view showing a front sealer of the electrical connector not mounted in position yet.
Figure 4:
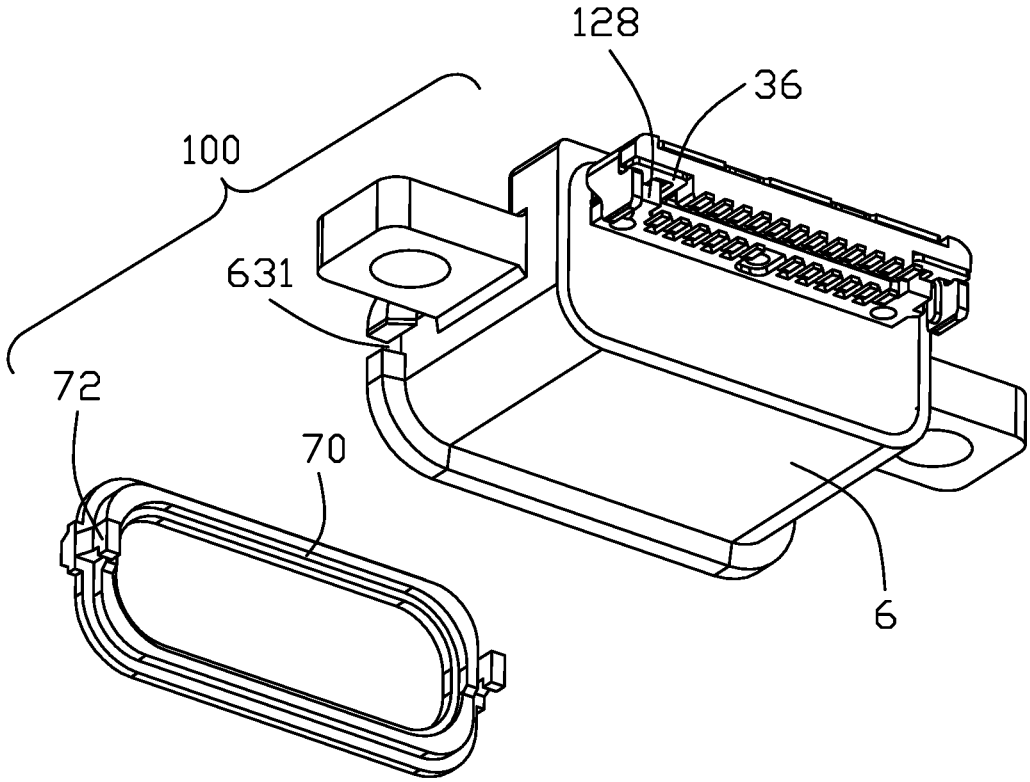
FIG. 4 is a view similar to FIG. 3 but from another perspective.
Figure 5:
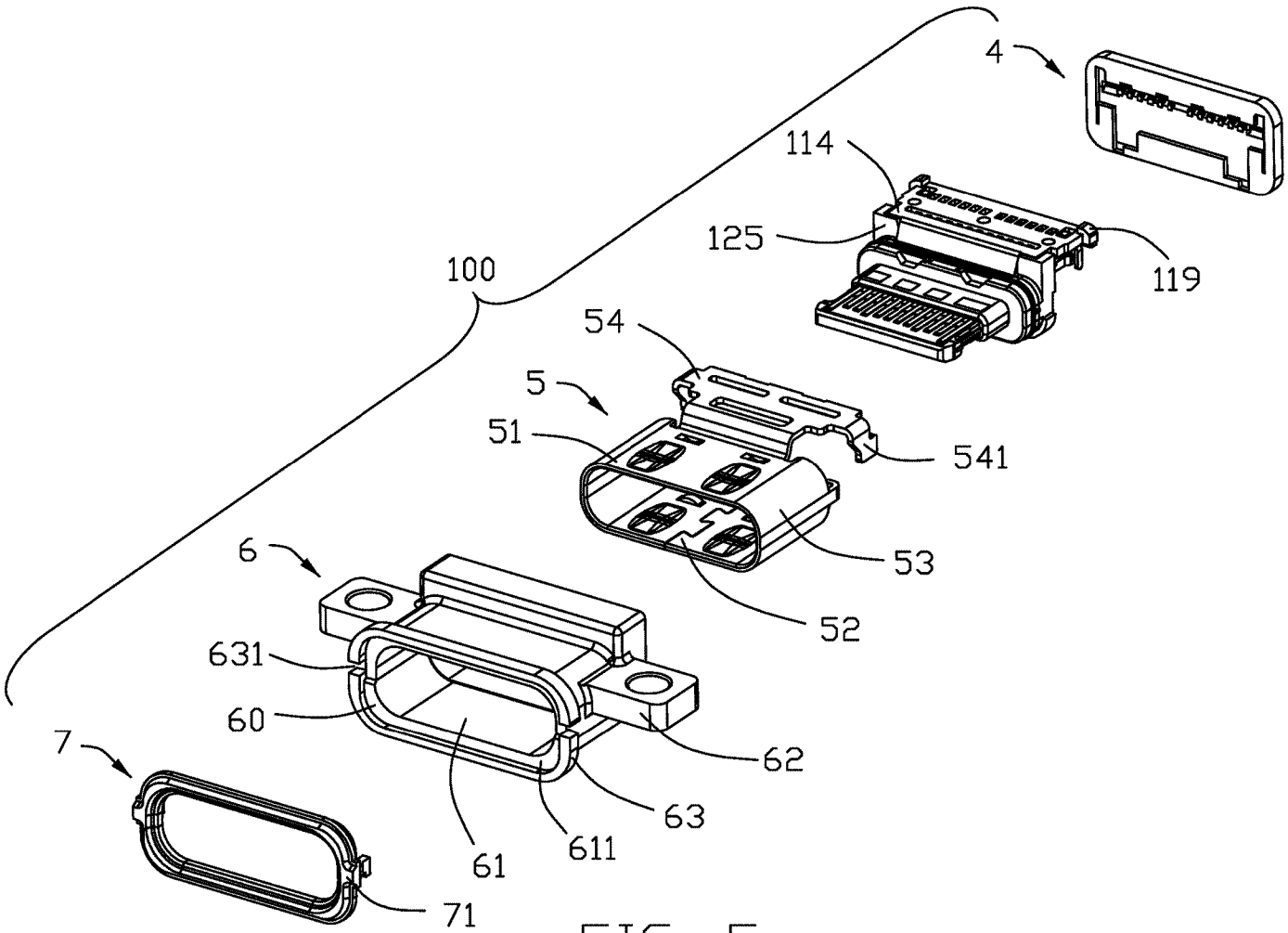
FIG. 5 is an exploded view of the electrical connector.
Figure 6:
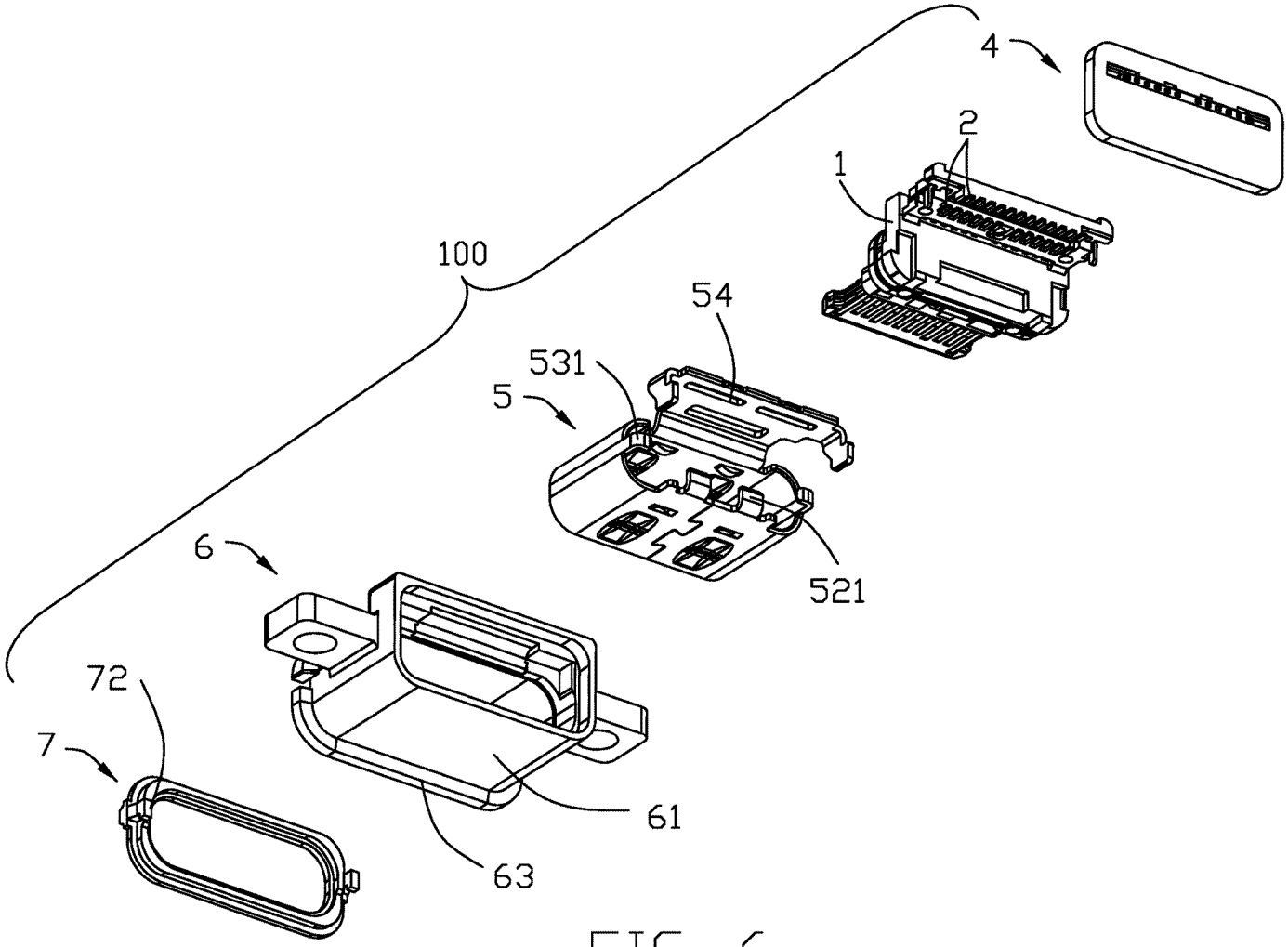
FIG. 6 is a view similar to FIG. 5 but from another perspective.
Figure 7:
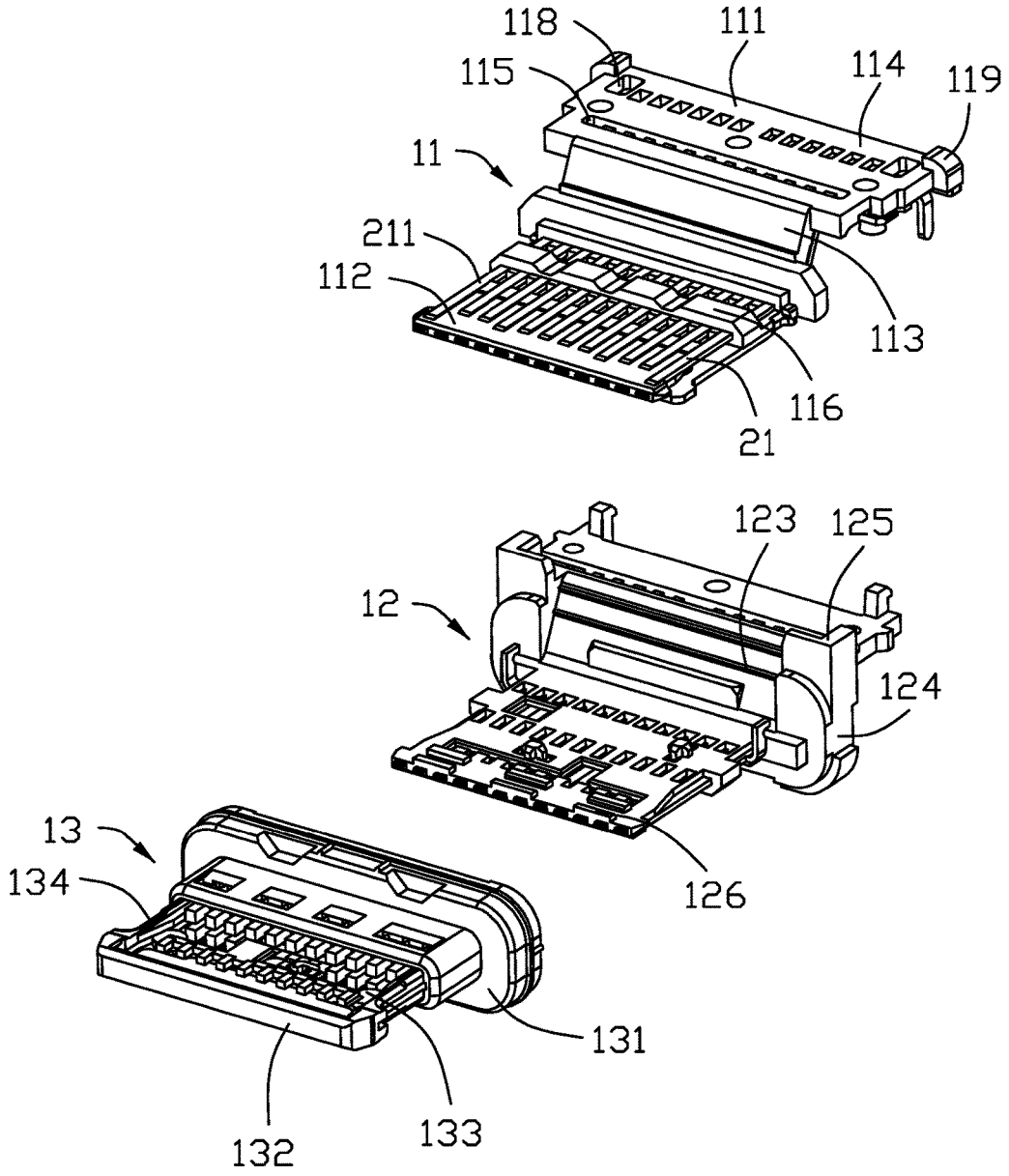
FIG. 7 is an exploded view of an insulative housing and a plurality of contacts of the electrical connector.
Figure 8:
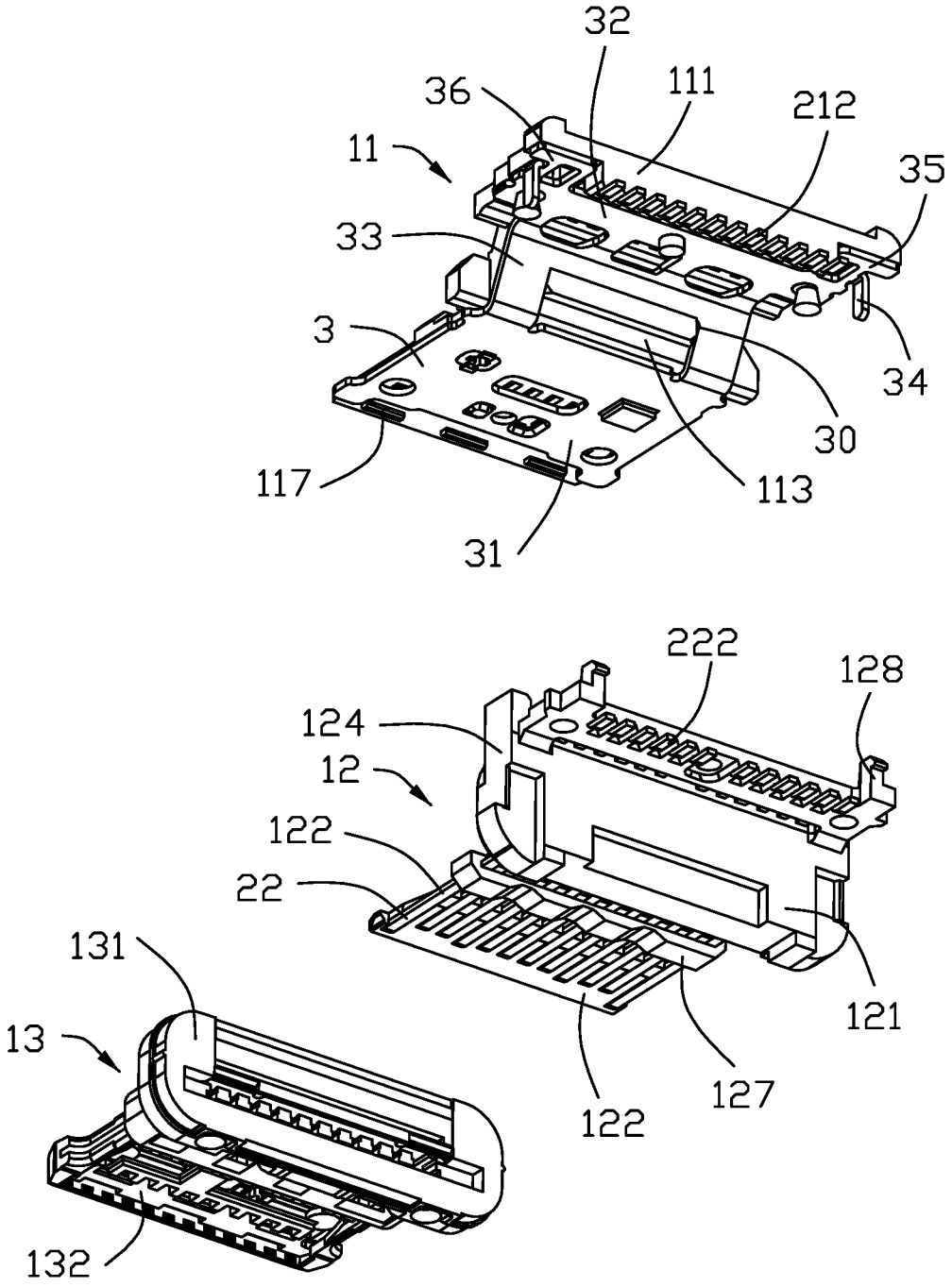
FIG. 8 is a view similar to FIG. 7 but from another perspective.
Figure 9:
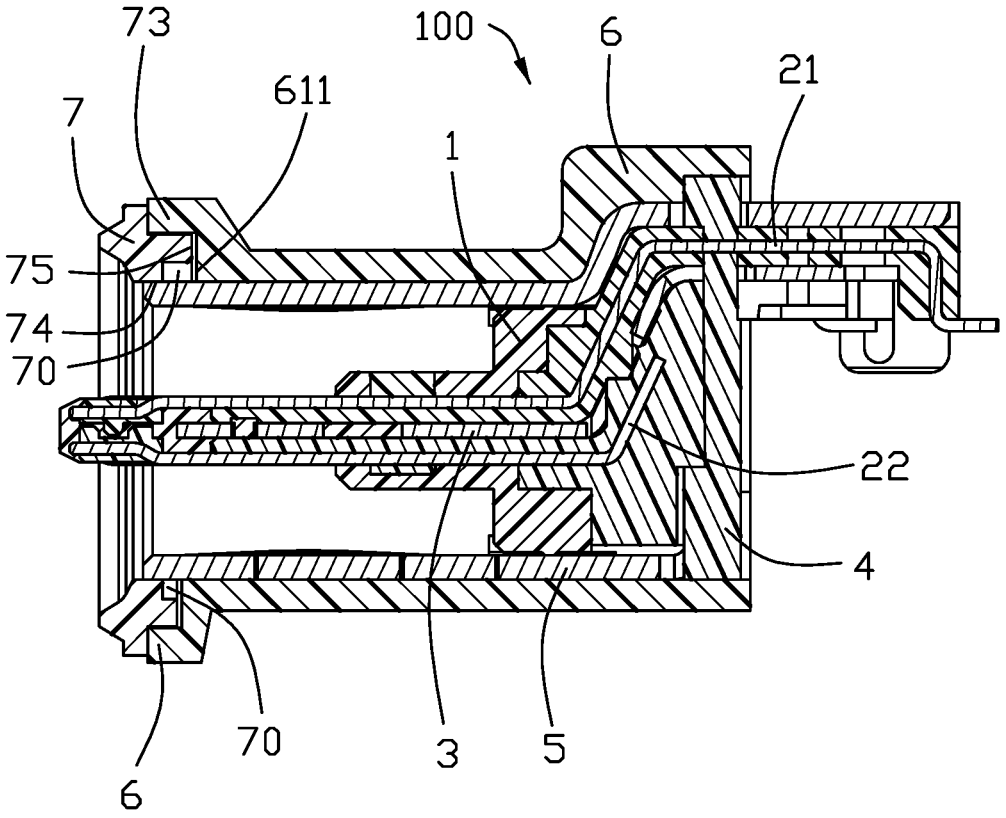
FIG. 9 is a cross-sectional view of the electrical connector taken along line A-A in FIG. 1.

Referring again to FIGS. 1-6, the shielding shell 5 includes a top wall 51, a bottom wall 52, and a pair of side walls 53. The top wall 51 has an extension 54. The bottom wall 52 has a pair of fixing legs 521 and the side walls 53 have a pair of fixing legs 531; the top wall extension 54 has a pair of fixing legs 541. The pair of fixing legs 541 clamp the base 111 of the first insulator 11. The fixing leg 541 has a step 542 for engaging the securing portion 35 of the metal plate 3 and the abutments 119 of the insulative housing 1 abut the top wall extension 54, as shown in FIG. 3. In this embodiment, the shielding shell 5 defines a mating cavity to enclose the tongue and forwardly communicate with an exterior in a front-to-back direction.

Referring again to FIGS. 1-9, the outer cover 6 is insulative and tubular and includes a main body 61 and a pair of side wings 62. The main body 61 has a front end wall 611 and an annular protrusion 63 to define a space 60. The protrusion 63 has a pair of side slots 631. An annular slot (not labeled) derived from the space 60, is further defined radially between a front end region of the shielding shell 5 and the protrusion 63 of the outer cover 6. The rear end of the main body 61 is generally rectangular to snugly accommodate the base 121 of the second insulator 12 so that the sealer 4 effectively seals the rear of the main body 61.

The sealer 7 is substantially annular and includes a rear annular part received within the aforementioned unlabeled annular slot, a front annular part situated in front of the outer cover protrusion 63, a pair of side portions 71, and a pair of hooks 72 behind the side portions 71. The side portions 71 engage the side slots 631 of the outer cover protrusion 63 and the hooks 72 secure the engagement. The sealer 7 has a main body disposed in the annular slot. The rear annular part has an outer surface 73 bearing against the protrusion 63 and an inner surface 74 bearing against the shielding shell 5. In this embodiment, a groove or escaping space 70 (next to a remaining portion 75) is provided on the sealer 7 at the inner surface 74 to receive any material that might come from during formation of the rear sealer 4; such material, if present, will otherwise adversely affect or hinder mounting of the front sealer 7. If desired, the outer cover 6 may be metallic.

Figure 10:
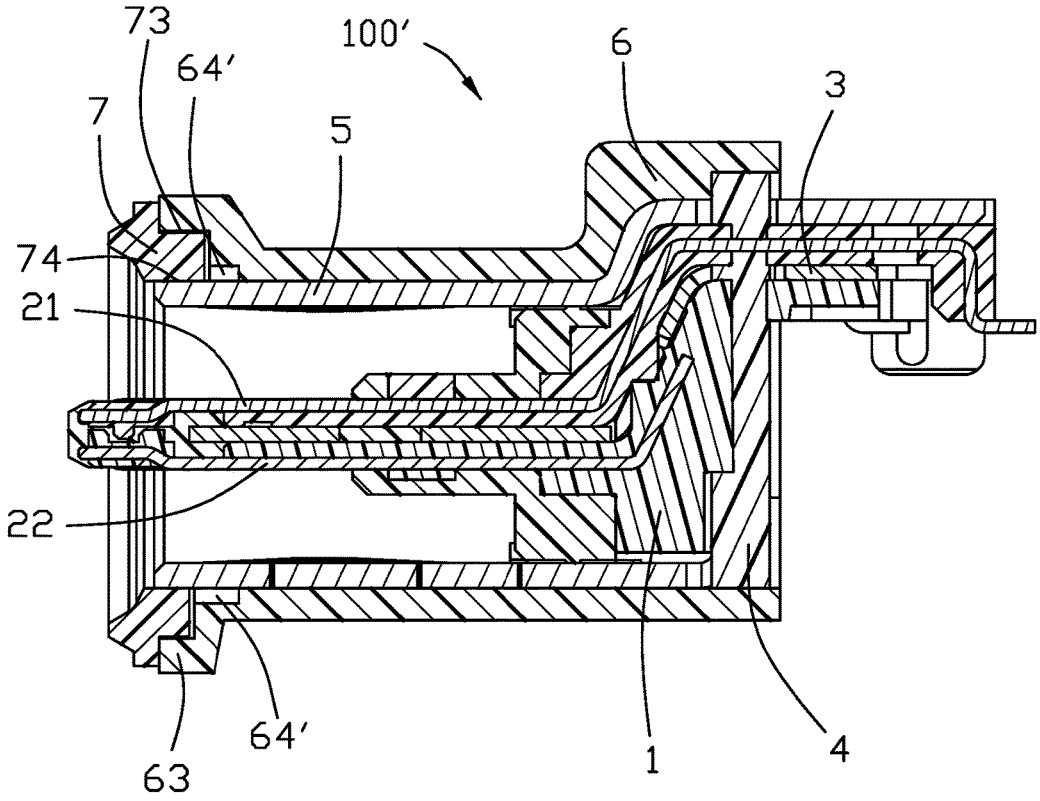
FIG. 10 is a view similar to FIG. 9 but showing an electrical connector in accordance with a second embodiment of the present invention.

Referring to FIG. 10 which shows an electrical connector 100' of a second embodiment, the electrical connector 100' does not have a groove, like the groove 70, provided on the sealer 7. Rather, such a groove 64' is provided on the outer cover 6 at the front end wall 611.

Figure 11:
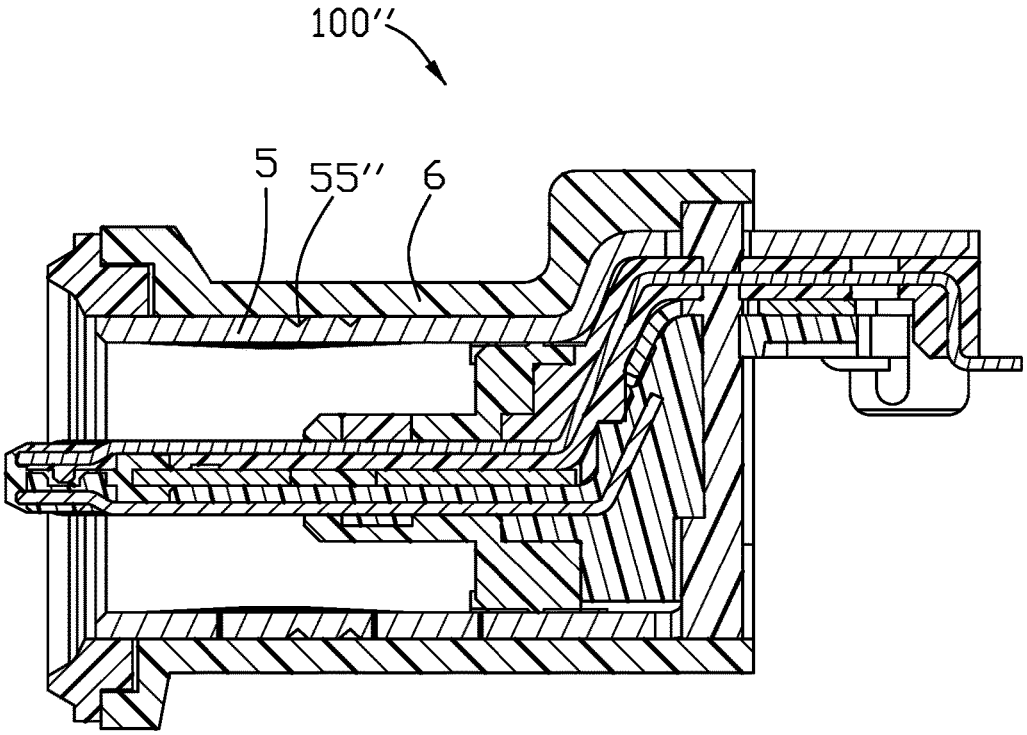
FIG. 11 is a view similar to FIG. 9 but showing an electrical connector in accordance with a third embodiment of the present invention.

Referring to FIG. 11 which shows an electrical connector 100" of a third embodiment, the electrical connector 100" does not have a groove provided on either the sealer 7 or the outer cover 6. Rather, such a groove 55' is provided on the shielding shell 5 at an outer surface thereof directly facing an inner surface of the outer cover 6. One or more grooves 55' may be provided. In the invention, the outer surface of the shielding shell 5 is deemed to abut against the inner surface of the outer cover 6 radially, i.e., perpendicular to the front-to-back/mating direction. Also, the rear annular part of the sealer 7 is essentially sandwiched between the inner surface of the outer cover 6 and the outer surface of the shielding shell 5 radially. According to the aforementioned embodiments, the groove or escaping space may be formed in the inner surface of the sealer 7, or in the inner surface of the outer cover 6 or in the outer surface of the shielding shell 5 as long as such a groove or escaping space communicates with the outer surface of the shielding shell 5 where the leaking material from the rear sealer 4 may pass.

In brief, with provision of a groove on the shielding shell, or the outer cover, or the front sealer, or two of them, or all three, with such groove in fluid communication with the interfacing gap between the shielding shell and the outer cover, i.e., on the way detrimental material might exist, the front sealer 7 is ensured to be mounted and secured in place without risk of falling off or dislodgment.

What is claimed is:

1. An electrical connector comprising:

an insulative housing having a base and a tongue;

a plurality of contacts affixed to the insulative housing and exposed to the tongue;

a shielding shell enclosing the insulative housing and having a front end;

an outer cover enclosing the shielding shell and having a front protrusion, an annular slot being defined between the front end of the shielding shell and the front protrusion of the outer cover;

a rear sealer sealing an interfacing gap between the shielding shell and the outer cover; and a front sealer disposed in the annular slot and being in fluid communication with the interfacing gap; wherein at least one of the shielding shell, the outer cover, and the front sealer has a groove in fluid communication with the interfacing gap.

2. The electrical connector as claimed in claim 1, wherein the groove is provided at an inner surface of the front sealer.

3. The electrical connector as claimed in claim 1, wherein the groove is provided on a front end wall of the outer cover.

4. The electrical connector as claimed in claim 1, wherein the groove is provided on an outer surface of the shielding shell.

* * * * *